United States Patent [19]

Takada

[11] Patent Number: 4,571,107

[45] Date of Patent: Feb. 18, 1986

[54] CORNER COVER FOR USE IN BINDING

[76] Inventor: Saburo Takada, No. 7-22-6, Seijho, Setagaya-ku, Tokyo, Japan

[21] Appl. No.: 580,987

[22] Filed: Feb. 16, 1984

[51] Int. Cl.[4] ..... B42F 13/06; B42D 5/00; B42B 5/00

[52] U.S. Cl. ..... 402/14; 281/3 R; 412/33

[58] Field of Search ..... 402/14, 15, 18, 20, 402/22, 23; 412/33; 281/42, 3 R; 283/36, 37; 116/234

[56] References Cited

U.S. PATENT DOCUMENTS

| | | | |
|---|---|---|---|
| 305,040 | 9/1884 | Ball | 402/14 |
| 687,437 | 11/1901 | Reynolds et al. | 402/14 |
| 1,172,190 | 2/1916 | Baugh | 402/14 |
| 1,637,832 | 8/1927 | Miller | 402/14 |
| 2,853,043 | 9/1958 | Bitterman et al. | 281/42 |
| 3,298,714 | 1/1967 | Celmer | 281/42 |
| 3,697,100 | 10/1972 | Hawkins | 281/42 |
| 4,184,699 | 1/1980 | Lowe, Jr. | 281/42 |
| 4,329,191 | 5/1982 | Barber | 283/36 |

FOREIGN PATENT DOCUMENTS

| | | | |
|---|---|---|---|
| 8444 | of 1909 | United Kingdom | 402/14 |

*Primary Examiner*—Paul A. Bell
*Assistant Examiner*—Paul M. Heyrana, Sr.
*Attorney, Agent, or Firm*—Armstrong, Nikaido, Marmelstein & Kubovcik

[57] ABSTRACT

A corner cover for use in binding comprises a sheet member of a rectangle having shorter sides and longer sides. The longer sides are about over two times longer than the shorter sides. The sheet member is provided with a hold line which is positioned on a side of an equilateral and right-angled triangle to be formed by in combination with the remaining two equal sides of the triangle. The two equal length sides are one of the shorter sides of the sheet member and a portion of the longer side. The corner cover is attached at a corner of a booklet with a staple, and is fixed with adhesive agent around the corner.

4 Claims, 8 Drawing Figures

CORNER COVER FOR USE IN BINDING

BACKGROUND OF THE INVENTION

This invention relates to a corner cover and more particularly it relates to a corner cover which is used when a pamphlet or booklet made of printed or hand-written papers is fastened together with a staple.

It is known in the art that printed or hand-written papers are fastened together with thread, wire, or adhesive and are enclosed with protective front and back covers to neatly make up a pamphlet or booklet. Without employing the above technique which requires a relatively high cost and expensive time and labor, an alternative more simple binding method has been widely used with which only a single staple is used to bind papers at one of the corners of a booklet or the like.

A binding method with a single U-shaped piece of metal, however, has been found not satisfactory in that top and bottom paper or papers are torn by the staple during turning over of the pages, and are separated from the remainder of the document. This is because, when turning over pages, an external force is given to a localized position where the staple and the bound pages contact with each other.

Moreover, a pamphlet or booklet with a single piece of metal at one of the corners thereof makes a poor appearance, and the staple only has no function other than binding.

SUMMARY OF THE INVENTION

Therefore, it is an object of the present invention to provide a novel corner cover for use in binding printed or hand-written papers with a single staple, which corner cover can eliminate a localized force upon the papers and can prevent the removal of pages.

It is another object of the present invention to provide a novel corner cover as above which can give not only a good appearance to the bound booklet or pamphlet, but also can give an index function.

One aspect of the present invention to be disclosed hereinafter will be described briefly. The corner cover of the present invention is made of a sheet member of a rectangular shape whose longer sides are about over two times the length of the shorter sides. There is provided on the corner cover or sheet member a fold line, the fold line being formed on one side of an isosceles triangle whose other two remaining sides are respectively one of the shorter sides of the rectangular sheet member and a portion of one of the longer sides thereof. When this corner cover is used, it is first applied on one of the corners of a booklet such that the triangle portion is properly placed in alignment with the corner of the booklet. Thereafter, the corner cover and the printed pages of the booklet are fastened together with a staple at about the middle of the triangle portion. By virtue of the fold line on the sheet member, it is easy to fold and turn over the sheet member along the fold line. The folded sheet member is then attached to both front and back corners of the bound booklet with adhesive agent. The booklet bounded in such a manner lessens the possibility of the removal of the pages which might be caused by the localization of the external force. This is because the surface of the staple is uniformly covered with the sheet member attached with adhesive agent, so that the external force given between the staple and the pages are divered into a broader area, without being converged upon a localized place where the staple and the pages contact with each other.

In accordance with another aspect of the present invention, there is provided with a layer of pressure sensitive adhesive which is formed on at least the front portion of the triangle of the corner cover, and or is formed of the whole area of the back portion of the corner cover. Therefore, mounting operation of the corner cover upon the corner of the booklet can readily be performed. In accordance with still another aspect of the present invention, at least the whole front area of the corner cover excepting the area of the triangle is colored so that the corner cover itself can serve as an index for the booklet.

While the specification concludes with the claims which particularly point out and distinctly claim the subject matter which is regarded as inventive, it is believed the invention will be more clearly understood when considering the following detailed description taken in conjunction with the accompanying drawings.

DETAILED DESCRIPTION OF THE PREFERRED EMBODIMENTS

Preferred embodiments of the corner cover according to the present invention will now be described with reference to FIGS. 1*a* through 1*c* and FIGS. 2*a* through 2*c*.

Figure 1A:
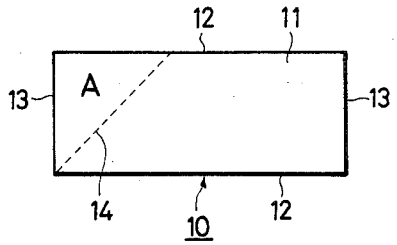
FIGS. 1*a* and 2*a* are respectively plan views showing first and second embodiments of the corner cover in accordance with the present invention.
Figure 2A:
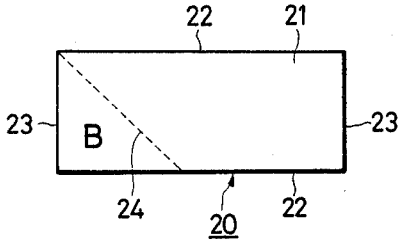
Figure 1B:
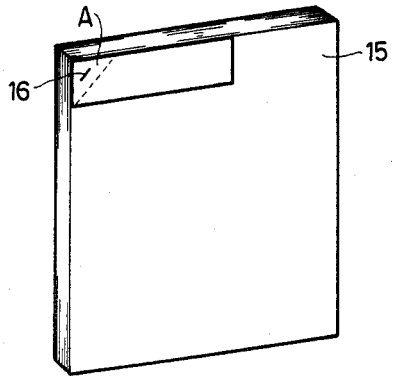
FIGS. 1*b* and 1*c* are respectively perspective views for illustrating the mounting method of the corner cover of the first embodiment on one of the corners of a booklet.
Figure 2B:
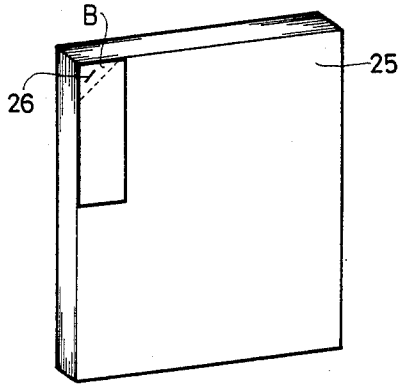
FIGS. 2*b* and 2*c* are respectively perspective views for illustrating the mounting method of the corner cover of the second embodiment on one of the corners of a booklet.
Figure 1C:
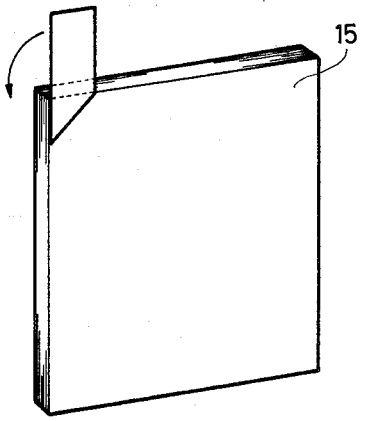
Figure 2C:
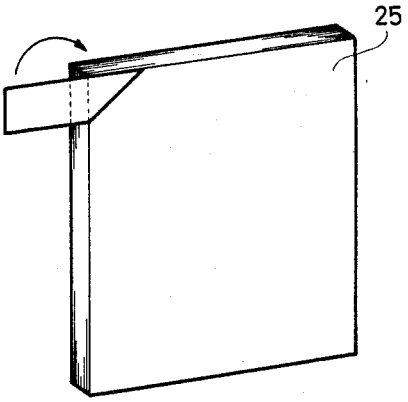

FIGS. 1*a* through 1*c* are shown for illustrating a first embodiment of the corner cover according to the present invention, while FIGS. 2*a* through 2*c* are shown for illustrating a second embodiment of the present invention.

In FIGS. 1*a* and 2*a*, reference numerals 10 and 20 respectively and generally designate the corner covers of the two embodiments. The corner covers 10 and 20 each are made of a sheet member 11,21 such as paper. The material of the sheet member is preferably paper. However, it is also possible to use a plastic sheet of the nature that is durable. The sheet member is preferably thicker than a printed paper or hand-written paper to be used for the booklet or pamphlet.

The sheet member 11,21 is of a rectangle, whose longer sides 12,22 are about two times longer than shorter sides 13,23. The longer sides 12,22 can be arranged to have a length sufficient for covering the booklet to be bound. As described later, it is preferable to determine the length of the longer sides of the corner cover such that the surface of the staple appearing on the back corner of the booklet can be covered with the corner cover folded and turned over upon the back.

For one of the shorter sides 13,23 (that is a left side shorter side in the drawing) of the sheet member 11,21, a fold line 14,24 is provided. The fold line 14,24 forms an isosceles triangle in combination with the shorter side 13,23 and a portion of one of the longer sides 12,22 (an upper longer side in the drawing). The fold line 14,24 is depicted with ink or is printed, as shown by dotted lines in the drawings, on the back surface of the sheet member 11,21, the back surface being the front surface of the drawings of FIGS. 1*a* and 2*a*. The dotted line can be replaced with a solid line. In other words, the fold line is provided for the purpose of giving a help in folding the sheet member 11,21 along the fold line to thereby turn over it and to cover the back corner of the booklet, as is later described. Alternatively, the fold line 14,24 thus depicted or printed on the sheet member 11,21 can be replaced with a crease line treated directly upon the material of the sheet member 11,21. The crease line referred herein is of the kind that the line is made up by directly treating the material of the sheet member 11,21 so that the member 11,21 can easily be folded along the line.

In the above embodiments, a single fold line 14 or 24 is provided for each sheet member 11 or 21. However, two fold lines can be provided for each sheet member 11 or 21 with both lines intersecting each other. More in particular, another line is added for the sheet member 11 which forms an isosceles triangle in combination with the left side shorter side 13 and the lower longer side 12, while another fold line is added for the sheet member 21 which forms an isosceles triangle in combination with the left side shorter side 23 and the lower longer side 22.

The construction of the corner cover 10,20 of the present invention has been described above. Another modification of the present invention will be described. A layer of pressure sensitive adhesive 17,27 is formed on the front surface of the sheet member 11,21 (the front surface being the back surface of the drawings of FIGS. 1*a* and 2*a* and illustrated in FIGS. 1*d* and 2*d* at the equilateral and right-angled triangle portion (A,B). A similar sheet of pressure sensitive adhesive can also be provided on the whole back surface of the sheet member 11,21. Also, it is preferable to provide a protective layer on the layer of pressure sensitive adhesive, the protective layer having a pressure release surface facing the pressure sensitive adhesive.

According to a still further modification of the present invention, it is preferable to color the sheet member 11,21 of the corner cover 10,20. The area to be colored can be all of the surfaces of the sheet member 11,21 or can be the whole front surface excepting at least the area corresponding to the equilateral and right-angled triangle portion (A,B).

The method for binding a booklet or the like by using the corner cover 10,20 described above will now be described. First, as shown in FIGS. 1*b* and 2*b*, printed or hand-written papers are piled upon each other to form a booklet 15,25. The sheet member 11,21 is placed upon the booklet 15,25 in the manner, as shown in the drawings, that the corner edges of the booklet 15,25 are in exact alignment with the shorter side 13,23 and the longer side 12,22. In this case, the back surface of the sheet member 11,21 is exposed outwards. Thereafter, the sheet member 11,21 is bound with a staple at the middle portion of the triangle portion (A,B). Reference numerals 16,26 each represent the surface of the staple thus bound.

Next, the sheet member 11,21 is folded along the fold line 14,24. Thus, the front surface of the sheet member 11,21 appears outwards as shown in FIGS. 1*c* and 2*c*. The mounting of the corner cover 10,20 is completed after turning over the sheet member 11,21 toward the back corner of the booklet 15,25, as shown by the arrows in the drawings. In the case that a layer of pressure sensitive adhesive is not provided for the front surface of the triangle portion (A,B) of the sheet member 11,21, it is preferable to bind with a staple after attaching an adhesive agent upon the portion (A,B).

As seen from the above description, the sheets of the booklet, particularly the upper and lower several sheets of the booklet are uniformly fixed against both the triangle portion (A,B) and the portion folded underneath the back corner of the booklet. As a result, when the pages are turned, the force acting against the top pages is distributed over the area of the triangle and, in particular, along the folded edge of the triangle and is not limited to the two points at which the staple penetrates the pages.

Figure 1D:
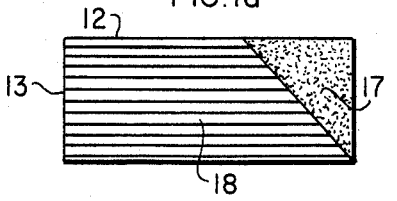
FIGS. 1*d* and 2*d* are plan views of the front on the corner cover in the two embodiments.
Figure 2D:
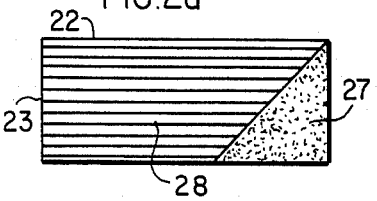

In addition, an index function is given for the booklet by coloring the surface of the sheet member as indicated by 18 and 28 in FIGS. 1*d* and 2*d*. Further, an index can be written on the front surface areas of the sheet member corresponding to the front and back corner portions and backbone portion of the booklet.

Other embodiments of the invention will be apparent for those skilled in the art from a consideration of the specification or practice of the invention disclosed herein. It is intended that the specification and examples be considered as exemplary only, with the true scope and spirit of the invention being indicated by the following claims.

What is claimed is:

1. In combination, a reinforcing cover for the corner of a document, and a multi-sheet document bound at a corner by a staple: said cover consisting of a sheet member formed from a flexible, foldable, non-metallic material, being in the form of a rectangle having a short side and a long side at least twice as long as said short side, said sheet member being folded along a line dividing one of the angles of said rectangle and at an angle such that the fold line forms the base of an isosceles triangle, one side of said triangular portion of said sheet material being superimposed over the inner corner of a first sheet of said bound documents, stapled thereto and folded along said fold line so as to wrap around a portion of the exposed edge of said bound documents.

2. A corner cover for use in binding as set forth in claim 1, in which said sheet member is made of paper.

3. A corner cover for use in binding as set forth in claim 1, in which said sheet member is provided with a layer of pressure sensitive adhesive at least on the front surface of said isosceles triangle portion.

4. A corner cover for use in binding as set forth in claim 1, in which a whole front surface of said sheet member excepting at least said isosceles triangle portion is colored.

* * * * *